US005871663A

United States Patent [19]

Turner

[11] Patent Number: 5,871,663

[45] Date of Patent: Feb. 16, 1999

[54] ADDITIVE COMPOSITION FOR REDUCING ANTHRAQUINONE REQUIREMENTS IN PULPING OF LIGNOCELLULOSIC MATERIAL

[75] Inventor: William T. Turner, Lakeland, Fla.

[73] Assignee: Westvaco Corporation, New York, N.Y.

[21] Appl. No.: 814,680

[22] Filed: Mar. 11, 1997

[51] Int. Cl.[6] ..... D21C 3/20

[52] U.S. Cl. ..... 252/175; 162/72; 162/75; 162/76; 162/DIG. 3; 510/421; 252/351

[58] Field of Search ..... 162/158, 164.7, 162/179, 72, 75, 76, 77, DIG. 3; 252/175, 351; 510/421

[56] References Cited

U.S. PATENT DOCUMENTS 5,032,224 7/1991 Ahluwalia ..... 162/75
5,298,120 3/1994 Blackstone ..... 162/76

*Primary Examiner*—Peter Chin
*Assistant Examiner*—Steven B. Leavitt
*Attorney, Agent, or Firm*—Terry B. McDaniel; Daniel B. Reece, IV; Richard L. Schmalz

[57] ABSTRACT

An improved process for delignification of lignocellulosic raw material, such as wood chips, for the production of cellulose pulps for use in the manufacture of paper or paperboard and an improved pulping aid composition for use in said process are disclosed wherein the wood chips are treated in a closed reaction vessel with an alkaline pulping liquor with an amount of a cyclic keto compound, such as anthraquinone, included therein for achievement of a determined pulp yield, wherein the improvement comprises a reduction in the amount of anthraquinone required to achieve said yield by the addition to said alkaline pulping liquor, in addition to a reduced amount of the anthraquinone, a surfactant mixture comprising at least one alkyl alcohol alkoxylate and at least one polyoxyalkylene glycol ether of an ester of an acid selected from the group consisting of ricinoleic acid and 12-hydroxystearic acid.

13 Claims, No Drawings

ADDITIVE COMPOSITION FOR REDUCING ANTHRAQUINONE REQUIREMENTS IN PULPING OF LIGNOCELLULOSIC MATERIAL

BACKGROUND OF THE INVENTION

1. Field of the Invention

This invention relates to an improved additive composition and process for the delignification of lignocellulosic material, such as wood, with an alkaline pulping liquor of the kraft, or sulfate, alkaline pulping process. More particularly, the invention relates to lignocellulosic material delignification with kraft pulping liquors containing a cyclic keto compound (preferably, anthraquinone), permitting enhanced yield. Specifically, the invention relates to an improvement of said process wherein said enhanced yield is achieved at reduced anthraquinone levels via the inclusion of a surfactant mixture comprising at least one alkyl alcohol alkoxylate and at least one polyoxyalkylene glycol ether of an ester of an acid selected from the group consisting of ricinoleic acid and 12-hydroxystearic acid 2. Description of the Prior Art In the mid-1970s, a significant advance was made in the delignification of lignocellulosic material for the production of wood pulps upon the discovery of the benefits of using anthraquinone as a pulping additive to alkaline pulping liquors. Among the earliest public disclosures of such use of anthraquinone was U.S. Pat. No. 3,888,727, which taught treating lignocellulosic material with an alkaline pulping liquor containing anthraquinone sulfonic acid followed by oxygen delignification. More significantly, however, U.S. Pat. No. 4,012,280 taught that the poorer economics of the environmentally preferable soda pulping process could be improved to compete with the more environmentally offensive (in terms of odor) kraft process by incorporation of anthraquinone as a pulping additive. Although the benefits of increased yield of cellulosic pulp and increased rate of delignification (permitting lower energy consumption and higher throughput) were shown, the use of the improved, lower pollution potential soda process was not advanced. First, incorporating the relatively expensive anthraquinone in the soda process to make it productively competitive with the kraft process without antraquinone reduced its economic competitiveness. Second, the benefits of anthraquinone also were achieved in other (already more commercially employed) pulping process such as those employing kraft or polysulfide pulping liquors.

It was soon discovered, as disclosed in U.S. Pat. No. 4,213,821, that anthraquinone also benefited cooking wood chips in neutral sulfite pulping liquor (with a special case disclosed in U.S. Pat. No. 5,139,617), as well as in the alkaline pulping liquors. Methods for maximizing the benefits of anthraquinone were disclosed in U.S. Pat. Nos.: 4,127,439; 4,178,861; and 4,310,383. Also, due to anthraquinone's difficult-to-handle, water-insoluble, fine powder form, discoveries made to facilitate its dispersion in the pulping liquors are disclosed in U.S. Pat. Nos.: 4,248,663; 4,384,921; and 4,574,032. One disadvantage to anthraquinone use is its tendency to cause scaling problems in the cooking vessel. Methods to overcome this problem are disclosed in U.S. Pat. Nos.: 4,481,073 and 4,561,935. Finally, as a result of the relative high cost of anthraquinone, methods for recovering and reuse of the chemical are disclosed in U.S. Pat. Nos.: 4,197,168 and 4,310,383.

In spite of the aforementioned advances, there remains a need to improve the benefits of anthraquinone pulping (primarily reduction of energy and chemical requirements while improving yield) and to reduce its disadvantages (primarily cost and equipment scaling). One approach would be to replace a portion of the anthraquinone with an additive which provided some of the benefits of anthraquinone without providing the disadvantages which accompany its use.

Therefore, an object of this invention is to provide an improved pulping additive composition and process for delignification of a lignocellulosic raw material with a pulping liquor with anthraquinone for the production of a predetermined yield of cellulose pulp which composition and process permit the achievement of said yield, as well as other aforementioned benefits, with a reduced requirement of anthraquinone of at least 10%.

SUMMARY OF THE INVENTION

The above stated object is provided by the instant invention which is an improved additive composition and an improved process for delignification of lignocellulosic raw material, such as wood chips, for the production of cellulose pulps for use in the manufacture of paper or paperboard wherein the wood chips are treated in a closed reaction vessel with a pulping liquor with an amount of a cyclic keto compound, such as anthraquinone, included therein for achievement of a determined pulp yield, wherein the improvement comprises a reduction in the amount of anthraquinone required to achieve said yield by the addition to said alkaline pulping liquor, in addition to a reduced amount of the anthraquinone, a surfactant mixture comprising at least one alkyl alcohol alkoxylate and at least one polyoxyalkylene glycol ether of an ester of an acid selected from the group consisting of ricinoleic acid and 12-hydroxystearic acid.

DESCRIPTION OF THE PREFERRED EMBODIMENT(S)

The improved process of this invention comprises the steps of (1) treating lignocellulosic material in a closed reaction vessel with an alkaline pulping liquor containing a cyclic keto compound additive selected from the group consisting of naphthoquinone, anthraquinone, anthrone, phenanthrenequinone, the alkyl, alkoxy, and amino derivatives of said quinones, 6,11-dioxo-1H-anthral[1,2-c] pyrazole, anthraquinone-1,2-naphthacrinone, 7,12-dioxo-7,12-dihydroanthra[1,2-b]pyrazine, 1,2-benzanthraquinone, and 10-methylene anthrone, the treatment taking place at a maximum temperature of from about 150° to about 200° C. for a period from about 0.5 to about 480 minutes to achieve a determined pulp yield, and (2) displacing the pulping liquor from the lignocellulosic material with water or an aqueous liquor inert to the lignocellulosic material to obtain a determined yield of a delignified cellulosic material, wherein the improvement comprises a reduction in the amount of cyclic keto compound additive required to achieve said yield by the addition to the alkaline pulping liquor, in addition to a reduced amount of the cyclic keto compound, a surfactant mixture comprising at least one alkyl alcohol alkoxylate and at least one polyoxyalkylene glycol ether of an ester of an acid selected from the group consisting of ricinoleic acid and 12-hydroxystearic acid.

The delignified cellulosic material produced by the above two steps may be used without further treatment or may be subjected to conventional bleaching steps.

When the lignocellulosic material to be treated is wood, it is first converted into the form of chips. This step is not required when the lignocellulosic material is of fibrous form.

The lignocellulosic material may be refined between steps (1) and (2). Refining can be carried out with known equipment, such as a single disc or double disc refiner.

The process of this invention may be used to delignify either coniferous or deciduous species of wood. By coniferous is meant species such as pine, spruce, and balsam fir. By deciduous is meant species such as birch, aspen, eastern cottonwood, maple, beech, and oak.

The alkyl alcohol alkoxylate component of the surfactant mixture is preferably a $C_4$–$C_{30}$ alkyl alcohol alkoxylate prepared by reacting an alcohol, which may have either a linear or branched chain and may be either a primary or secondary alcohol, with from about 5 moles to about 100 moles of an alkylene oxide selected from the group of ethylene oxide, propylene oxide, butylene oxide, and any combination thereof. A particular preferred alkyl alcohol alkoxylate is oleyl alcohol ethoxylate prepared with 23 moles ethylene oxide.

The member of the group of polyoxyalkylene glycol ethers of an ester of an acid selected from the group of ricinoleic acid and hydroxy stearic acid can be prepared by reacting an ester of a glycol, selected from the group of glycerine, neopentyl glycol, trimethylolethane, trimethylolpropane, pentaerythritol and its polymers, mannitol, and sorbitol, with from about 5 moles to about 100 moles of an allylene oxide selected from the group of ethylene oxide, propylene oxide, butylene oxide, and any combination thereof. Inasmuch as ricinoleic acid is the primary component (~90%) of castor oil, although present as a triglyceride rather than in free acid form, castor oil may be alkoxylated directly to form the required polyoxyalkylene glycol ethers of the esters of ricinoleic acid. Therefore, a preferred member of this group is ricinoleic acid triglyceride ethoxylate.

U.S. Pat. Nos. 5,298,120 and 5,501,769 disclose pulping wood using fatty acid esters of polyoxyalkylene glycols to enhance pulping uniformity and pulp yield. While these esters may give the desired performance, there is an inherent weakness in the molecule when used in strongly alkaline solutions which are heated to high temperatures. The ester will cleave and form both a fatty acid soap and the polyalkylene glycol used to form the ester. Thus, it ceases to be the ester claimed. Also, the beneficial results are not being produced by the disclosed compound, rather the beneficial results are, in fact, diminished by the products of this cleavage.

This is not the case with the claimed alkyl alcohol polyalkylene glycol ethers and the polyalkylene glycol ether of ricinoleic acid triglyceride (of castor oil), which can give superior performance in the strong, hot alkaline solutions used in pulping wood. When the ester of the polyalkylene glycol ether of ricinoleic acid triglyceride cleaves, the resultant molecule will be the sodium salt of polyalkylene glycol ether of ricinoleic acid, which is a surfactant and which will have functionality in the pulping solution. The presence of the sodium salt of the polyalkylene glycol ether of ricinoleic acid will assist in solubilizing the alkyl alcohol polyalkylene glycol ethers in the hot, alkaline pulping solution as the pulping process is completed. The solubilization of the other surfactants is of great benefit since, otherwise, these other surfactants may precipitate out of solution and be of less benefit.

The composition of the invention is preferably a microemulsion prepared by combining an oleyl alcohol ethoxylate with a ricinoleic acid triglyceride ethoxylate in a weight ratio of from about 4:1 to about 1:4 (preferably, about 1:2), respectively. For combination with anthraquinone for use in alkaline pulping, an aqueous solution of the composition is prepared by blending with from about 10 to about 30% (preferably, about 20%) water, producing a clear viscous solution. This solution is, in turn, diluted with water to from about 10 to about 30% (preferably, about 12.5%) active when combined with the aqueous dispersion of anthraquinone. The invention surfactant composition should exhibit an HLB of from about 5 to about 20 preferably from about 8 to about 16. Upon combination of the components of the surfactant composition, a microemulsion is formed which exhibits an average particle size of from about 0.5 to about 10 $\mu$m, preferably from about 1 to about 4 $\mu$m, and most preferably less than 2 $\mu$m.

Evidence that a microemulsion of the proper average particle size to accomplish the observed synergism with anthraquinone has been formed is that, upon combination of the two components at ambient temperature, a transparent solution is formed, and, upon heating to about 180° F. (82° C.), the solution turns a hazy bluish color.

The cyclic keto compound, preferably anthraquinone, is preferably prepared as an aqueous dispersion which is combined with the invention surfactant compound prior to their addition to the cooking vessel. The anthraquinone dispersion is preferably prepared by the addition of a dispersant and by reducing the anthraquinone average particle size to from about 6 to about 10 $\mu$m in water by wet grinding or milling. A preferred dispersant may be a sodium lignosulfonate.

Although the surfactant composition and the anthraquinone dispersion may be added separately to the cooking vessel, it is preferred that they be combined prior to such addition and then added as a single aqueous blend. The surfactant microemulsion serves to coat the anthraquinone particles and allows the mixture of anthraquinone and pulping liquors to penetrate the wood chips at a faster rate and saturate them more efficiently and completely. It is envisioned that it is this mechanism which results in obtaining the desired kappa number and lower rejects using significantly less anthraquinone.

The benefits of the invention process and composition are seen in the following examples.

EXAMPLE 1

For comparison purposes, sixty-five wet tons of conifer wood chips were loaded into a pulping digester filled with kraft alkaline pulping liquors (providing an average of about 10,800 pounds active alkali) a liquor to wood ratio of about 3.45, after which 50 wet pounds of a 50% anthraquinone dispersion (0.08% by weight, based on the weight of oven dried wood chips) were added. The digester contents were heated up to a maximum temperature of 332° F. (166° C.) and the wood chips were cooked for 79 minutes to a kappa number of 91. The cook resulted in a yield of 54%, and rejects of 10%.

EXAMPLE 2

For use as an additional digestion aid to enhance the benefits of anthraquinone, several samples of the invention surfactant were prepared and evaluated for microemulsion performance. In varying proportions, an oleyl alcohol ethoxylate prepared with 23 moles ethylene oxide was combined with a ricinoleic acid triglyceride ethoxylate and water. In each case, upon blending the components together, a clear, viscous solution was formed.

| | | |
|---|---|---|
| Sample A: | oleyl alcohol ethoxylate • 23 moles EO | 20 parts by weight |
| | ricinoleic acid triglyceride etholxylate | 60 parts by weight |
| | water | 20 parts by weight |
| Sample B: | oleyl alcohol etholxylate • 23 moles EO | 40 parts by weight |
| | ricinoleic acid triglyceride ethoxylate | 40 parts by weight |
| | water | 20 parts by weight |
| Sample C: | oleyl alcohol ethoxylate • 23 moles EO | 60 parts by weight |
| | ricinoleic acid triglyceride ethoxylate | 20 parts by weight |
| | water | 20 parts by weight |

Each sample was diluted to 12.5 wt % with water and heated to 180° F. (82° C.). At ambient temperature all diluted samples gave transparent solutions, and at 180° F. (82° C.) each sample turned a hazy bluish color.

EXAMPLE 3

The process of Example 1 was again conducted; except, in place of the 0.08% anthraquinone, 0.06% by weight based on oven dried wood chips of a digestion aid comprised of the surfactant blend of Sample A from Example 2 and anthraquinone was added to the white liquor as the white liquor was simultaneously pumped into the digester while the wood chips were being added. Upon completion of the digestion cycle, a pulp having a kappa number of 90 was produced with rejects of under 10%.

Compared with the performance of anthraquinone alone in Example 1, it is noted that a reduction by 25% of digestion aid (using the invention pulping additive) gave a lower kappa number and a significantly lower reject level. Moreover, when a comparison is made based on the respective anthraquinone content of the respective digestion aids, a reduction in anthraquinone required of at least 50% is permitted by the invention surfactant composition.

Other advantages of using a digestion aid having less anthraquinone include:

1. Less tendency for formation of scale on the evaporator tubes and plugging of the tubes; and
2. Reduced contamination of the crude tall oil, which lessens problems in the tall oil refinery and reduces contamination of the tall oil heads fraction.

While the invention has been described and illustrated herein by references to various specific materials, procedures, and examples, it is understood that the invention is not restricted to the particular materials, combinations of materials, and procedures selected for that purpose. Numerous variations of such details can be employed, as will be appreciated by those skilled in the art.

What is claimed is:

1. An improved wood pulping aid composition comprising cyclic keto compound for addition to pulping liquors in the delignification of lignocellulosic raw material wherein the improvement comprises the addition of a surfactant mixture comprising at least one alkyl alcohol alkoxylate and at least one alkyl tri polyoxyalkylene glycol ether of an ester of an acid selected from the group consisting of ricinoleic acid and 12-hydroxystearic acid wherein the ratio of akyl alcohol alkoxylate to alkyl tri polyoxyalkylene glycol ether is from about 4:1 to about 1:4, respectively, and the composition exhibits an HLB of about 5 to about 20.

2. The improved composition of claim 1 wherein the alkyl alcohol alkoxylates are prepared by reacting one or more $C_4$–$C_{30}$ alkyl alcohols with a member of the group of oxides consisting of ethylene oxide, propylene oxide, butylene oxide, and any combination thereof.

3. The improved composition of claim 2 wherein the $C_4$–$C_{30}$ alkyl alcohols are derived from coconut oil, palm kernel oil, and petroleum.

4. The improved composition of claim 1 wherein the polyoxyalkylene glycol ether of an ester of an acid selected from the group consisting of ricinoleic acid and hydroxy stearic acid is prepared by reacting an ester of a glycol selected from the group consisting of glycerine, neopentyl glycol, trimethylolethane, trimethylolpropane, pentaerythritol and its polymers, mannitol, and sorbitol, with from about 5 moles to about 100 moles of an alkylene oxide selected from the group of ethylene oxide, propylene oxide, butylene oxide, and any combination thereof.

5. The improved composition of claim 1 wherein the reduction in the amount of the cyclic keto compound required is at least 25%.

6. The improved composition of claim 5 wherein the reduction in the amount of the cyclic keto compound required is at least 50%.

7. The improved composition of claim 1 wherein the cyclic keto compound is selected from the group of compounds consisting of naphthoquinone, anthraquinone, anthrone, phenanthrenequinone, the alkyl, alkoxy, and amino derivatives of said quinones, 6,11-dioxo-1H-anthrapyrazole, anthraquinone-1,2-naphthacridone, 7,12-dioxo-7,12-dihydroanthrapyrazine, 1,2-benzanthraquinone, and 10-methylene anthrone.

8. The improved composition of claim 5 wherein the cyclic keto compound and the surfactant mixture are introduced to the alkaline pulping liquor simultaneously via an aqueous blend in a ratio of from 10:1 to 1:10, respectively.

9. The improved composition of claim 2 wherein the $C_4$–$C_{30}$ alkyl alcohols are selected from the group consisting of primary alcohols and secondary alcohols having a linear or branched chain, and a combination thereof.

10. The improved composition of claim 2 wherein the member is reacted in an amount of from 5 to 100 moles.

11. The improved composition of claim 10 wherein the member is ethylene oxide.

12. The improved composition of claim 1 wherein the alkaline pulping liquor is comprises sodium hydroxide, sodium carbonate, and sodium sulfide.

13. The improved composition of claim 1 wherein the ester of ricinoleic acid is a triglyceride.

* * * * *